US007972184B2

(12) United States Patent
Hsieh et al.

(10) Patent No.: US 7,972,184 B2
(45) Date of Patent: Jul. 5, 2011

(54) CONTACT FOR BURN-IN SOCKET

(75) Inventors: Wen-Yi Hsieh, Tu-Cheng (TW); Ke-Hao Chen, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 7 days.

(21) Appl. No.: 12/549,408

(22) Filed: Aug. 28, 2009

(65) Prior Publication Data

US 2010/0055934 A1 Mar. 4, 2010

(51) Int. Cl.
*H01R 13/241* (2006.01)

(52) U.S. Cl. ..... 439/700

(58) Field of Classification Search ..... 439/700
See application file for complete search history.

(56) References Cited

U.S. PATENT DOCUMENTS 6,505,082 B1 * 1/2003 Scheiner et al. ..... 607/123
6,743,043 B2 6/2004 Yamada
6,902,410 B2 6/2005 Watanabe
6,966,549 B2 * 11/2005 Costello et al. ..... 267/89
7,025,602 B1 * 4/2006 Hwang ..... 439/66
7,256,593 B2 * 8/2007 Treibergs ..... 324/754.05
7,285,026 B1 * 10/2007 Ju ..... 439/700
7,467,952 B2 * 12/2008 Hsiao et al. ..... 439/66
7,520,754 B1 * 4/2009 Gattuso ..... 439/66
2008/0064236 A1 3/2008 Lin

* cited by examiner

*Primary Examiner* — Truc T Nguyen
(74) *Attorney, Agent, or Firm* — Andrew C. Cheng; Wei Te Chung; Ming Chieh Chang

(57) ABSTRACT

A contact for a burn-in socket electrically connecting an IC package and a printed circuit board, comprises a first contact, a second contact and a spring disposed between the first contact and the second contact. The first contact and the second contacts have a same configuration, and each contact has a U-shaped actuating portion with two legs and a conductive portion extending from one of the legs. The first contact and the second contact are orthogonally assembled together, and the first actuating portion bestrides the second actuating portion to clasp with second actuating portion, so that the conductive portions have an offset therebetween.

17 Claims, 6 Drawing Sheets

CONTACT FOR BURN-IN SOCKET

BACKGROUND OF THE INVENTION

1. Field of the Invention

The present invention relates to contact for burn-in socket which is used for connecting an IC package, such as a central processing unit (CPU), with a circuit substrate, such as a printed circuit board (PCB).

2. Description of the Prior Art

Related arts are referred in U.S. Pat. No. 6,902,410, issued on Jun. 7, 2005 to Tsuyoshi Watanabe, and U.S. Pat. No. 6,743,043 issued on Jun. 1, 2004 to Takayuki Yamada, and Patent Publication No. 2008-0064236, published on Mar. 13, 2008 to Chun-Fu Lin, these patents or patent application all relate to contact used for a burn-in socket for testing an electronic package with a printed circuit board (PCB) and comprising an upper contact and a lower contact. Referring to FIG. 1, US Patent Publication No. 2008-0064236 discloses a contact 1' including a first contact 10' and a second contact 11' interconnecting with the first contact 10'. The first contact 10' is formed with a first stopper portion 101', a contacting arm 103' extending from the first stopper portion 101' toward the second contact 11' and a first conductive portion 102' extending in an opposite direction relative to the contacting arm 103'. The second contact 11' has an elastic portion 113' contacting with the first contact 10', a second stopper portion 111' linking with a bottom of the elastic portion 113', and a second conductive portion 112' extending downwardly from the second stopper 111'. The contact 1' further has a spring 12' fitted over a predetermined area between the first stopper 101' and the second stopper 111' and abutting against the first stopper 101' and the second stopper 111' by its two opposite ends, respectively. The first conductive portion 102' contacts with a pad of an electronic package (not shown), and the second conductive portion 112' contacts with a pad of a printed circuit board (not shown). The first contact 10' and the second contact 11' contact each other when an outside force put on the contact 1' to compress the contact 1', the contact 1' is wholly located in a straight line and can be easily assembled to an insulative housing (not shown).

However, since the first contact 10' and the second contact 11' are arranged in a straight line, and the pad of the electronic package (not shown) must align with a corresponding pad of the printed circuit board (not shown) in a vertical direction. If the contact 1' needs to be used to connect another electronic package whose pad has an offset with a corresponding pad of the printed circuit board, the contact 1' must be assembled in an inclined way, which is a difficult assembling process, and even so, corresponding electrical connection between the another electronic package and the printed circuit board still can not be ensured due to the oblique arrangement of the contact 1'.

Accordingly, a new contact for burn-in socket that solves the above problems is desirable.

SUMMARY OF THE INVENTION

Accordingly, an object of the present invention is to provide a contact for a burn-in socket, which is capable of electrically connecting a pad of an electronic package which has an offset with respective to a corresponding pad of a printed circuit board on which the bun-in socket mounted.

To fulfill the above object, A contact for burn-in socket electrically connecting an IC package and a printed circuit board, comprises a first contact, a second contact and a spring disposed in a predetermined position between the first contact and the second contact. The first contact has a first conductive portion on a top end thereof and a first actuating portion. The second contact has a second conductive portion on a bottom end thereof and a second actuating portion clasping with the first actuating portion of the first contact. Both the first and the second conductive portions extend upright. A projection of the second conductive portion has an offset with respective to that of the first conductive portion in a horizontal plane.

Other objects, advantages and novel features of the present invention will become more apparent from the following detailed description when taken in conjunction with the accompanying drawings, in which:

DESCRIPTION OF PREFERRED EMBODIMENTS OF THE INVENTION

Reference is now made to the drawings to describe the invention in detail.

Figure 1:
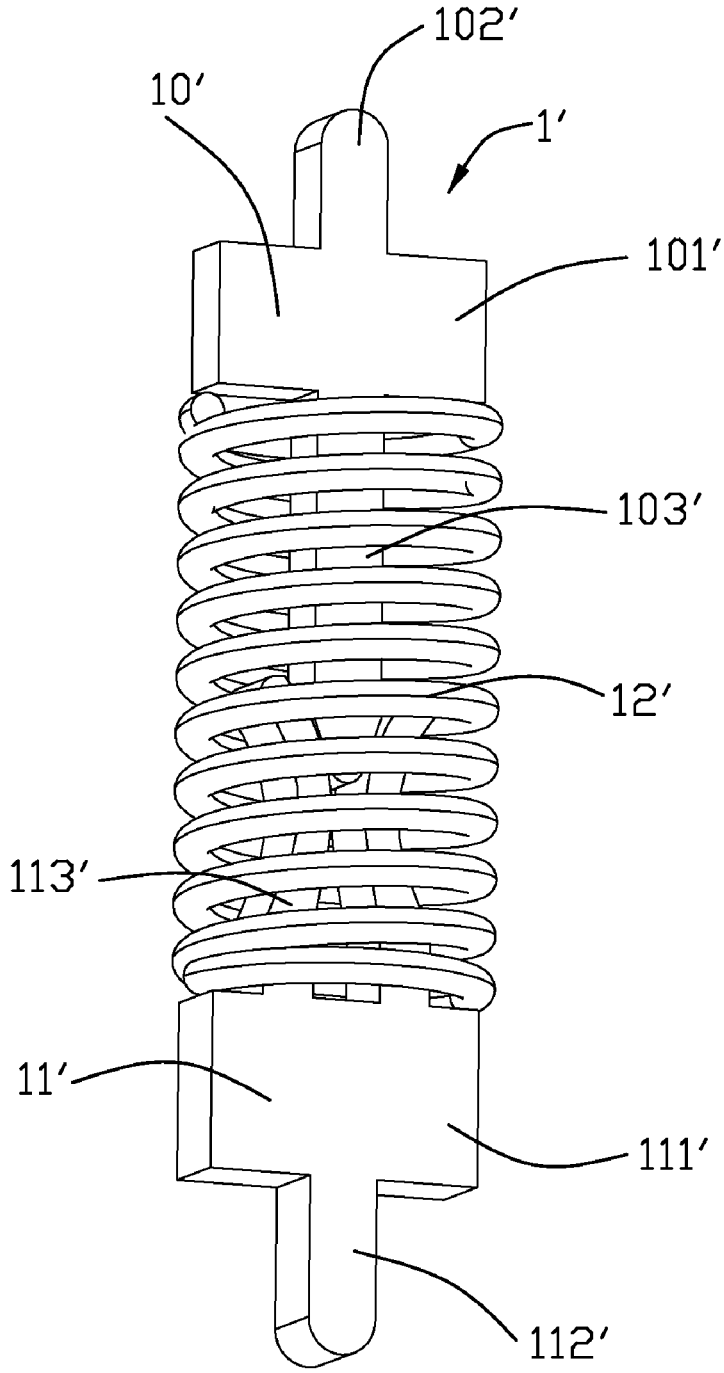
FIG. 1 (PRIOR ART)
FIG. 1 is an assembled, perspective view of a related contact.
Figure 2:
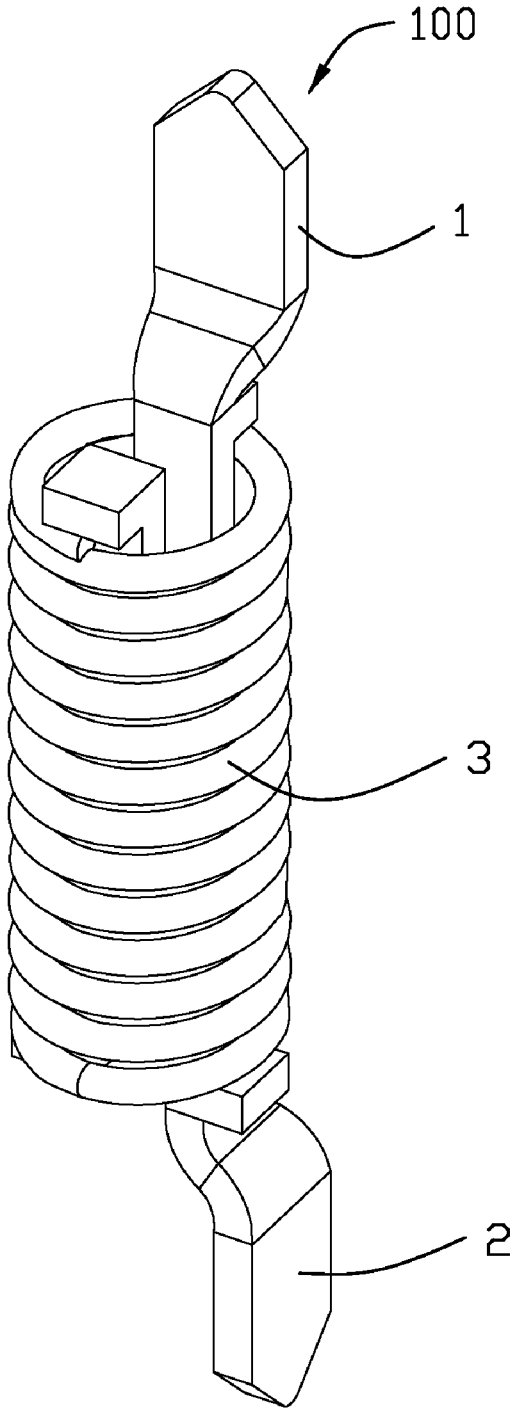
FIG. 2 is an assembled, perspective view of a contact in a preferred embodiment according to the present invention.
Figure 3:
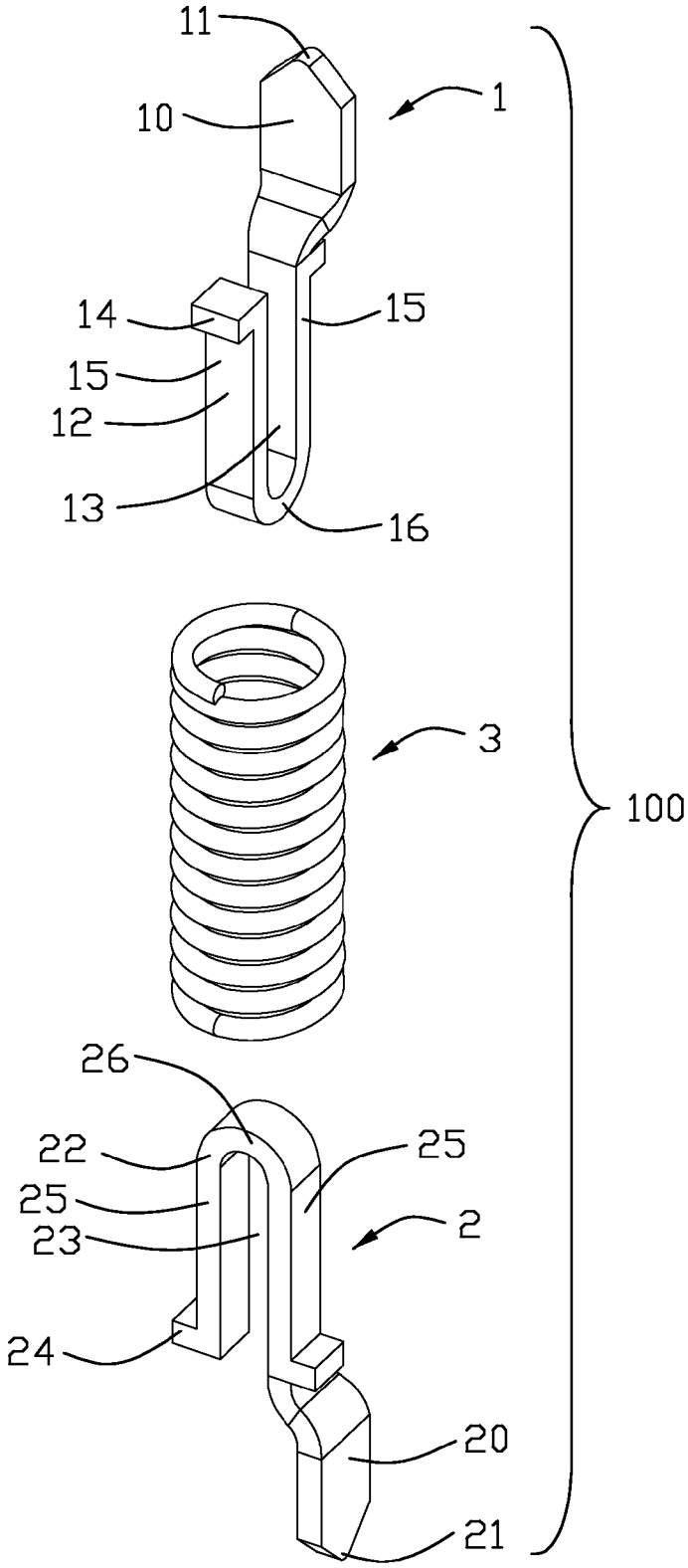
FIG. 3 is an exploded, perspective view of the contact in FIG. 2.
Figure 4:
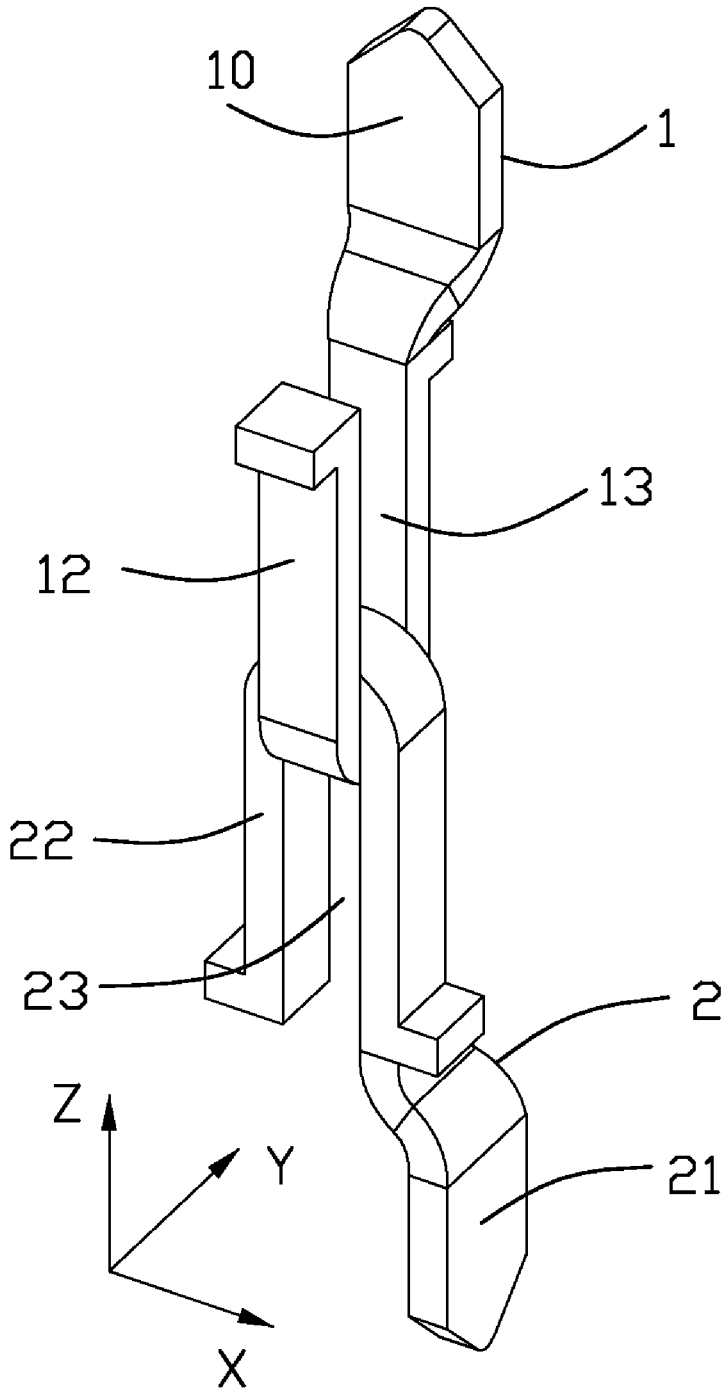
FIG. 4 is an assembled, perspective view of a first contact and a second contact.

Referring to FIGS. 2-3, a contact 100 used in a burn-in socket for testing an IC package (not shown) in a preferred embodiment according to the present invention is disclosed. The contact 100 has a first contact 1, a second contact 2 and a spring 3 surrounding the first contact 1 and the second contact 2. The first contact 1 and the second contact 2 are orthogonally assembled together, and the spring 3 is disposed between the first contact 1 and the second contact 2.

The first contact 1 has a first conductive portion 10, being in an upright board-like and having a first taper contacting head 11 connecting with a pad (not shown) of the IC package and a first U-shaped actuating portion 12 and defining a first vertical guiding slot 13 in the middle thereof. The actuating portion 12 has two legs 15 extending substantially in the vertical direction and a bridge 16 connecting bottom end of the legs 15. The first conductive portion 10 extends upwardly and outwardly from one of the legs 15. The first actuating portion 12 is further formed with two first board-like blocking portions 14 extending horizontally and outwardly from free ends of the two legs 15 thereof, respectively, and adapted for abutting against the spring 3.

The second contact 2 engages with the first contact 1 and can movable in a vertical direction. The second contact 2 has a same configuration with the first contact 1 in this preferred embodiment, and comprises a second conductive portion 20 with a second taper contacting header 21, a second actuating portion 22 with two legs 26 and a bridge 26, a second guiding slot 23, two second blocking portions 24, and the second contacting header 21 is used for electrically contacting with a pad of a printed circuit board (not shown).

The spring 3 surrounds the first actuating portion 12 and the second actuating portion 22. A top and a bottom ends of the spring 3 abut against the first blocking portions 14 and the second blocking portions 24, so that the spring 3 is fixed between the first contact 1 and the second contact 2.

When assembling, the spring 3 ring around the first actuating portion 22 of the second contact 2, then the spring 3 is compressed to move downwardly a certain distance till the other leg 15 of the first actuating portion 12, which does not connect with the first conductive portion 10, inserts and passes through the second guiding slot 23 of the second contact 2, so that the first actuating portion 12 bestrides the bridge 26 of the second actuating portion 22 to connect the first actuating portion 12 and the second actuating portion 22 together, then the spring 3 is released and abuts against the first blocking portion 14 and the second blocking portion 23 by its two ends, at this moment, the first contact 1, the second contact 2 and the spring 3 are assembled to form the contact 100. The first contact 1 and the second contact 2 are movable relative to each other, the first and the second actuating portions 12, 22 clasps each other and are movable along the second guiding slot 23 and the first guiding slot 13, respectively.

Figure 5:
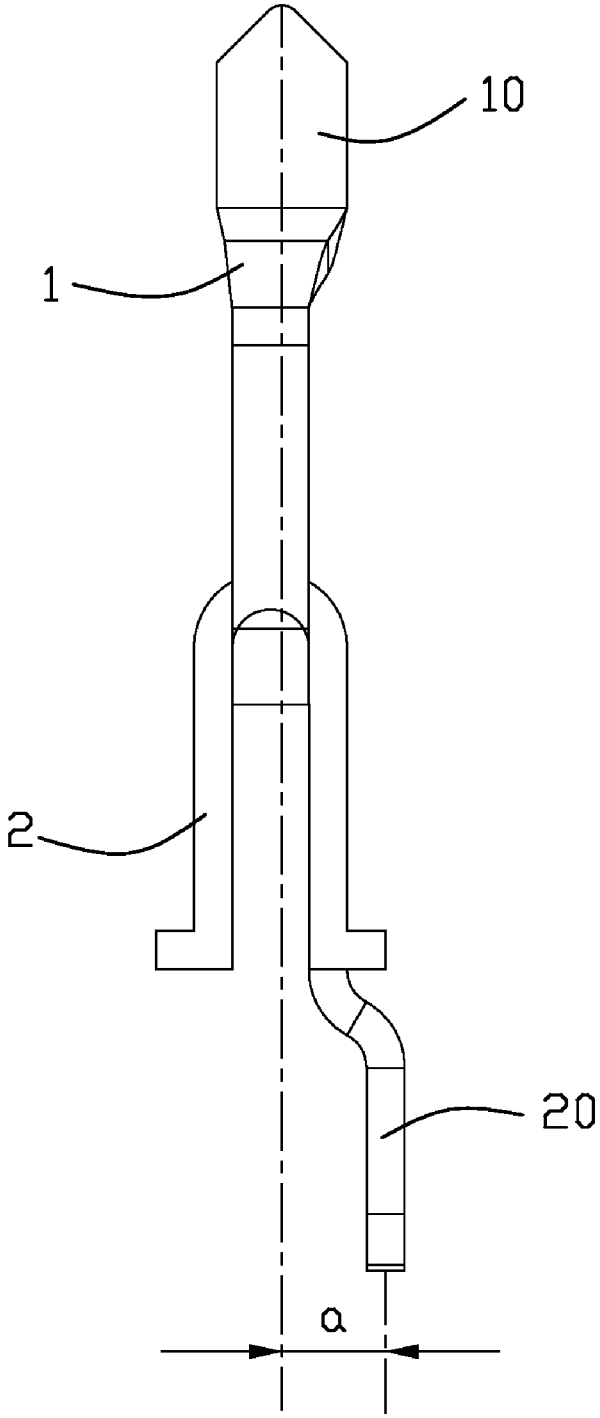
FIG. 5 is a plan view of taken along Y direction in FIG. 4.
Figure 6:
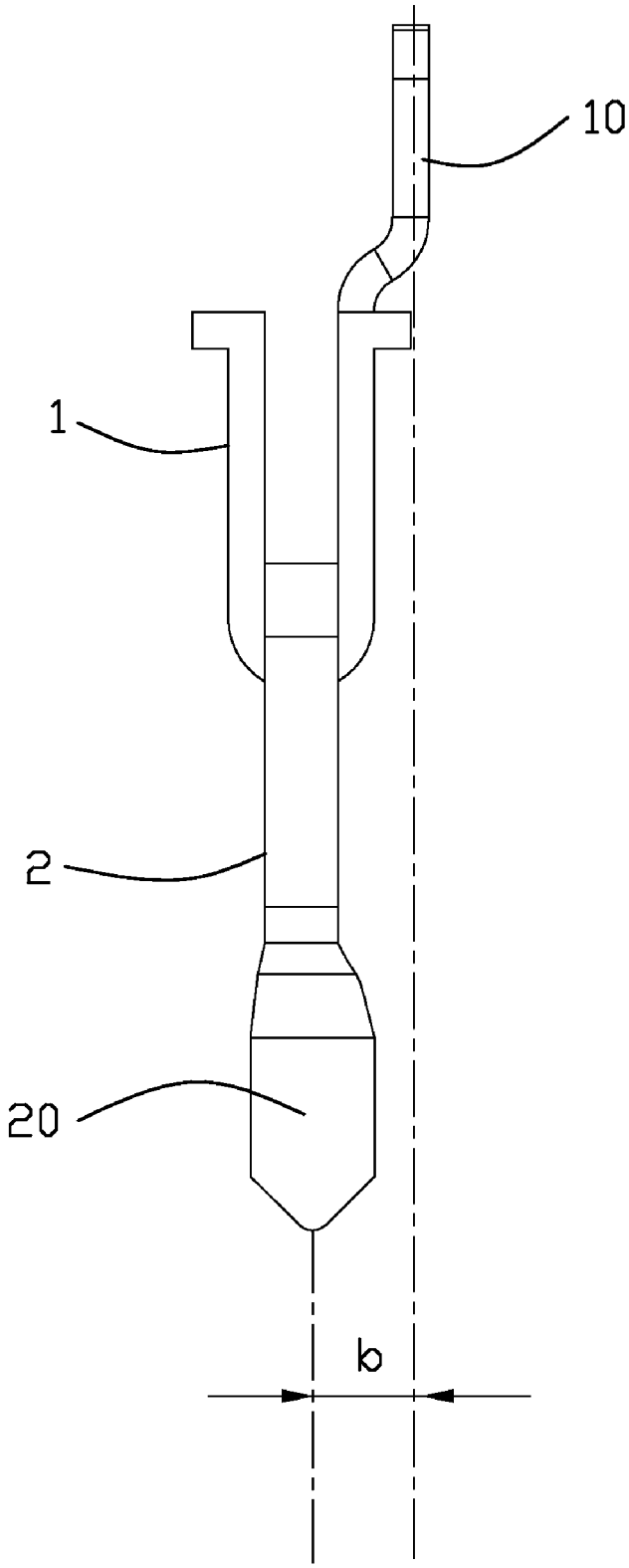
FIG. 6 is a plan view taken along reverse X direction in FIG. 4.

The first contact 1 and the second contact 2 are both movable, when be pressed by an outside force, the first contact 1 and the second contact 2 can move along the second and the first guiding slots 23, 13 of each other and synchronously compress the spring 3. The spring 3 forces the first contact 1 and the second contact 2 to return to original positions when the outside force is released. The first and the second contacting headers 11, 21 of the first contact 1 and the second contact 2 electrically connect with pads (not shown) of the electronic package (not shown) and the printed circuit board (not shown), respectively. Referring to FIG. 5 and FIG. 6, projections of the first conductive portion 10 and the second conductive portion 20 are not overlapped in a horizontal plane, the second conductive portion 20 has an offset a and an offset b relative to the first conductive 10 along the X, Y direction, respectively. So the contact 100 can electrically connect the IC package (not shown) whose pad (not shown) has an offset with respect to a corresponding pad (not shown) of the printed circuit board (not shown) in a horizontal plane.

The first contact 1 and the second contact 2 have a same configuration that may benefit for producing, the first and the second actuating portions 12, 22 clasp with each other, and the first and the second guiding slots 13, 23 can guide the second and the first actuating portions 22, 12, respectively, to ensure reliably movement between the first contact 1 and the second contact 2.

Furthermore, although the present invention has been described with reference to particular embodiments, it is not to be construed as being limited thereto. Various alterations and modifications can be made to the embodiments without in any way departing from the scope or spirit of the present invention as defined in the appended claims.

What is claimed is:

1. A contact for burn-in socket electrically connecting an IC package and a printed circuit board, comprising:

a first contact having a first conductive portion disposed on a top end thereof and having a projection extending upright and a first actuating portion, the actuating portion defining a first guiding slot with an up opening, and the conductive portion located beside the opening;

a second contact having a second conductive portion disposed on a bottom end thereof and extending upright and a second actuating portion orthogonally striding across the first guiding slot to clasp the first actuating portion of the first contact, the second conductive portion having a projection offsetting with respect to the projection of the first conductive portion in a horizontal plane; and a spring disposed in a predetermined position between the first contact and the second contact.

2. The contact of claim 1, wherein the first actuating portion is U-shaped with two legs and a bridge linking bottom ends of the two legs, and the first guiding slot is defined between the two legs, the up opening is formed between top ends of the two legs, and the first conductive portion extends upwardly from the top end of one of the two legs.

3. The contact of claim 2, wherein the second actuating portion of the second contact moves along the first guiding slot of the first contact.

4. The contact of claim 2, wherein the first contact and the second contact have a same configuration.

5. The contact of claim 2, wherein the second actuating portion also is a U-shape with two legs and a bridge linking two top ends of the two legs and defines a second guiding slot between the two legs of the second actuating portion for the first actuating portion to move along.

6. The contact of claim 5, wherein the first contact and the second contact are orthogonally assembled together, the bridge of the second contact is located over that of the first contact.

7. The contact of claim 4, wherein each of the first and the second actuating portions has two blocking portions extending horizontally and outwardly from the top or the bottom ends of corresponding two legs to abut against the spring.

8. A contact for a burn-in socket electrically connecting an IC package and a printed circuit board, comprising:

a first contact having a first U-shaped actuating portion with two legs and a bridge linking bottom ends of the legs and a first conductive portion extending upwardly from a top end of only one of the legs and outwardly away from a top end of the other leg so that both the two legs are located on a same lateral side of the conductive portion in a horizontal direction;

a second contact having a second actuating portion and a second conductive portion extending downwardly from the second actuating portion, the second actuating portion clasping the first actuating portion of the first contact to assemble the first and the second contact together; and a spring disposed in a predetermined position between the first contact and the second contact.

9. The contact of claim 8, wherein the second actuating portion is also a U-shaped configuration with two legs and a bridge linking top ends of the two legs of the second actuating portion.

10. The contact of claim 9, wherein the first contact and the second contact are orthogonally assembled together, and the first actuating portion bestrides the second actuating portion so that the bridge of the first contact is located over that of the second contact.

11. The contact of claim 10, wherein each of the first and the second actuating portions has two blocking portions extending horizontally and outwardly from corresponding ends of corresponding two legs to abut against the spring.

12. The contact of claim 11, wherein the first contact and the second contact have a same configuration.

13. The contact of claim 12, wherein the second conductive portion extends downwardly from only one of the legs of the second actuating portion.

14. A contact set for contacting upper and lower exterior pieces, comprising:

an upper half and a lower half interwoven with each other and sharing a same center line with each other, the upper half extending and lying in a first plane, the lower half extending and lying in a second plane perpendicular to the first plane;

a coil spring surrounding said interwoven upper half and lower half and urging the upper half and the lower half away from each other in a vertical direction; and the upper half defining only one prong tip arranged in an asymmetrical manner relative to the center line, for contacting the upper exterior piece, and being offset from the center line in a first direction with a first distance, and the lower half defining only one prong tip arranged in an asymmetrical manner relative to the center line, for contacting the lower exterior piece, and being offset from the center line in a second direction with a second distance; wherein at least either the first direction is different from the second direction or the first distance is different from the second distance so that a force imposed upon the upper half by the upper exterior piece is essentially not aligned along the center line, and a force imposed upon the lower half by the lower exterior piece is essentially not aligned along the center line.

15. The contact set as claimed in claim 14, wherein a bottom end of the upper half and that of the lower half are interlocked with each other in the vertical direction when the upper half and the lower half move away from each other in a relatively outermost position.

16. The contact set as claimed in claim 15, wherein both the bottom ends of said upper half and said lower half are of a U-shaped configuration with two legs and a bridge linking the two legs.

17. The contact set as claimed in claim 16, wherein the bridges of said upper half and the lower half are orthogonally disposed, and the bridges of the lower half is located over that of said upper half.

* * * * *